US010201986B2

(12) United States Patent
Kawashima

(10) Patent No.: US 10,201,986 B2
(45) Date of Patent: Feb. 12, 2019

(54) SHEET CONVEYANCE DEVICE AND IMAGE FORMING APPARATUS INCLUDING THE SAME

(71) Applicant: KYOCERA Document Solutions Inc., Osaka-shi, Osaka (JP)

(72) Inventor: Tetsuro Kawashima, Osaka (JP)

(73) Assignee: KYOCERA Document Solutions Inc. (JP)

( * ) Notice: Subject to any disclaimer, the term of this patent is extended or adjusted under 35 U.S.C. 154(b) by 0 days.

(21) Appl. No.: 15/833,226

(22) Filed: Dec. 6, 2017

(65) Prior Publication Data

US 2018/0162147 A1 Jun. 14, 2018

(30) Foreign Application Priority Data

Dec. 13, 2016 (JP) ..... 2016-240825

(51) Int. Cl.

| | |
|---|---|
| ***B41J 11/00*** | (2006.01) |
| ***B41J 13/10*** | (2006.01) |
| ***B41J 13/08*** | (2006.01) |
| ***B65H 5/22*** | (2006.01) |
| ***B41J 11/06*** | (2006.01) |
| *B65H 5/02* | (2006.01) |

(52) U.S. Cl.

CPC ..... *B41J 11/007* (2013.01); *B41J 11/0085* (2013.01); *B41J 11/06* (2013.01); *B41J 13/08* (2013.01); *B41J 13/103* (2013.01); *B65H 5/22* (2013.01); *B65H 5/222* (2013.01); *B65H 5/228* (2013.01); *B65H 5/025* (2013.01)

(58) Field of Classification Search

CPC ..... B41J 11/007; B41J 11/0085; B41J 11/06; B41J 13/08; B41J 13/103; B65H 5/22; B65H 5/222; B65H 5/228; B65H 5/025

USPC ..... 347/104

See application file for complete search history.

(56) References Cited

U.S. PATENT DOCUMENTS 9,010,920 B2 * 4/2015 Nishimura ..... B41J 11/002 347/102
2017/0275122 A1 * 9/2017 Herrmann ..... B65H 29/247

FOREIGN PATENT DOCUMENTS

JP 2008-222418 9/2008

* cited by examiner

*Primary Examiner* — Huan Tran
*Assistant Examiner* — Alexander D Shenderov
(74) *Attorney, Agent, or Firm* — Gerald E. Hespos; Michael J. Porco; Matthew T. Hespos

(57) ABSTRACT

A sheet conveyance device transports a sheet to a predetermined processing unit, and includes a conveyance belt, a ventilation unit, and a suction unit. The conveyance belt has a first surface and a second surface, and is arranged to be opposed to the processing unit to transport the sheet on the first surface in a predetermined conveyance direction. On an upstream side of the processing unit in the conveyance direction, the ventilation unit blows out wind toward the sheet to adhere the sheet to the first surface of the conveyance belt. The suction unit is arranged to be opposed to the processing unit with the conveyance belt interposed therebetween to generate a negative pressure between the sheet adhered to the first surface by the ventilation unit and the conveyance belt, thereby bringing the sheet into close contact with the first surface of the conveyance belt.

7 Claims, 10 Drawing Sheets

SHEET CONVEYANCE DEVICE AND IMAGE FORMING APPARATUS INCLUDING THE SAME

The present application claims priority from Japanese Patent Application No. 2016-240825 filed on Dec. 13, 2016, disclosure of which is all incorporated herein by reference.

BACKGROUND

The present disclosure relates to a sheet conveyance device including a conveyance belt which conveys sheets, and an image forming apparatus including the sheet conveyance device.

Image forming apparatuses such as a printer, a copying machine, a facsimile machine, and the like each include a sheet feeding unit which feeds sheets, a sheet conveyance device which conveys sheets fed by the sheet feeding unit, and an image forming unit which forms an image on a sheet conveyed by the sheet conveyance device.

Among those known as a sheet conveyance device which conveys a sheet to an image forming unit is a conveyance device including a conveyance belt which conveys a sheet, and a suction unit. In this sheet conveyance device, the suction unit generates a suction force between a sheet and a conveyance belt to bring the sheet into close contact with the conveyance belt, so that the sheet thus being in close contact is conveyed by the conveyance belt.

SUMMARY

A sheet conveyance device according to the present disclosure is a sheet conveyance device which conveys a sheet to a predetermined processing unit, and includes a conveyance belt, a ventilation unit, and a suction unit.

The conveyance belt has a first surface and a second surface on a side opposite to the first surface, and is arranged to be opposed to the processing unit to convey the sheet on the first surface in a predetermined conveyance direction. On an upstream side of the processing unit in the conveyance direction, the ventilation unit blows out air toward the sheet to adhere the sheet to the first surface of the conveyance belt. The suction unit is arranged to be opposed to the processing unit with the conveyance belt interposed therebetween to generate a negative pressure between the sheet adhered to the first surface by the ventilation unit and the conveyance belt, thereby bringing the sheet into close contact with the first surface of the conveyance belt.

Additionally, an image forming apparatus according to another aspect of the present disclosure includes the above sheet conveyance device, and an image forming unit, as the processing unit, which forms an image on a sheet conveyed by the conveyance belt of the sheet conveyance device.

DESCRIPTION OF EMBODIMENTS

In the following, description will be made of a sheet conveyance device and an image forming apparatus according to one embodiment of the present disclosure with reference to the drawings. The following description will be made using XYZ orthogonal coordinate axes regarding directions. An X direction corresponds to a front-rear direction (+X represents a rear and −X represents a front), a Y direction corresponds to a right and left direction (+Y represents left and −Y represents right), and a Z direction corresponds to an up-down direction (+Z represents up and −Z represents down). Additionally, in the following description, the term "sheet" denotes copy paper, coated paper, an OHP sheet, a board, a postcard, tracing paper, other sheet material to be subjected to image forming processing, or a sheet material to be subjected to other arbitrary processing than the image forming processing.

[Entire Configuration of Image Forming Apparatus]

Figure 1:
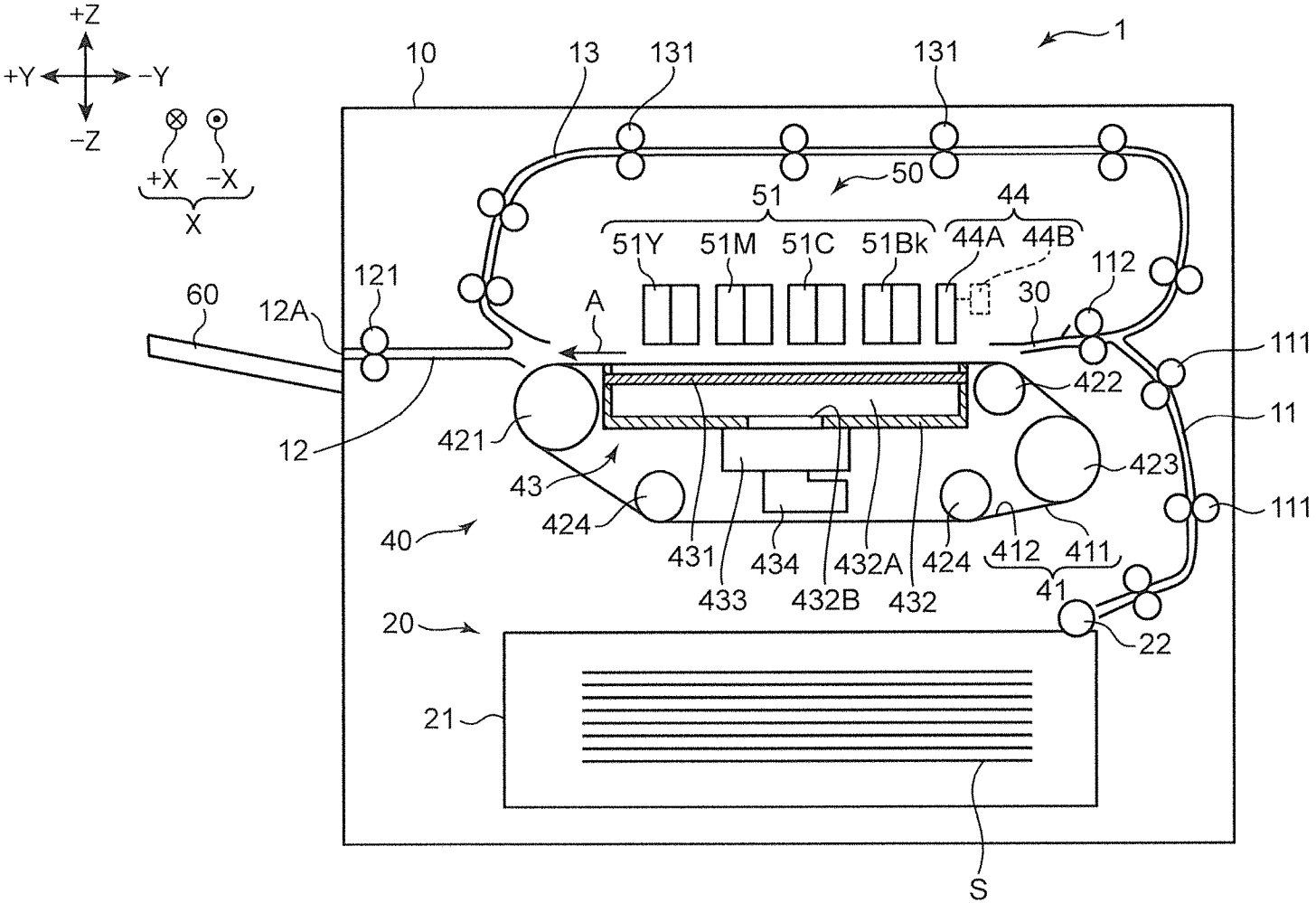
FIG. 1 is a view schematically showing an image forming apparatus including a sheet conveyance device according to one embodiment of the present disclosure.

FIG. 1 is a view schematically showing an image forming apparatus 1 including a sheet conveyance device 40 according to one embodiment of the present disclosure. The image forming apparatus 1 is an ink jet recording apparatus which discharges ink drops to form (record) an image on a sheet S. The image forming apparatus 1 includes an apparatus main body 10, a sheet feeding unit 20, a guide unit 30, the sheet conveyance device 40, an image forming unit 50, and a sheet ejection tray 60 as a sheet ejection unit.

The apparatus main body 10 is a box-shaped casing which houses various devices for forming an image on the sheet S. In the apparatus main body 10, there are formed a first conveyance path 11, a second conveyance path 12, and a third conveyance path 13 serving as sheet S conveyance paths.

The sheet feeding unit 20 feeds the sheet S to the first conveyance path 11. The sheet feeding unit 20 includes a sheet feeding cassette 21 and a pickup roller 22. The sheet feeding cassette 21 is detachable to the apparatus main body 10 and houses the sheet S inside thereof. The pickup roller 22 is arranged on an end portion on a −Y side (a right side) and a +Z side (an upper side) of the sheet feeding cassette 21. The pickup roller 22 takes out the sheet S one by one from the sheet feeding cassette 21 and sends out the same to the first conveyance path 11.

The sheet S fed to the first conveyance path 11 is transported toward a pair of resist rollers 112 by a pair of first conveyance rollers 111 provided on the first conveyance path 11. The pair of resist rollers 112 has a function of correcting oblique conveyance of the sheet S. This adjusts a position of an image formed on the sheet S. The pair of resist rollers 112 sends out the sheet S toward the sheet conveyance device 40 via the guide unit 30 at timing of image forming processing by the image forming unit 50.

The guide unit 30 guides the sheet S sent out by the pair of resist rollers 112 toward a first surface 411 of a conveyance belt 41 in the sheet conveyance device 40.

The sheet S guided by the guide unit 30, when a front end portion thereof touches the first surface 411 of the conveyance belt 41, is transported in a sheet conveyance direction A by drive of the conveyance belt 41, the sheet being held on the first surface 411. The sheet conveyance direction A is a direction heading, in the Y direction (the right and left direction), from the −Y side (the right side) to a +Y side (left side). Detailed configuration of the sheet conveyance device 40 will be described later.

On the +Z side (the upper side) of the sheet conveyance device 40, the image forming unit 50 is arranged. Specifically, on the +Z side (the upper side) of the sheet conveyance device 40, the image forming unit 50 is arranged so as to be opposed to the first surface 411 of the conveyance belt 41. The image forming unit 50, which functions as a processing unit that subjects the sheet S to predetermined processing, subjects the sheet S conveyed in the sheet conveyance direction A to the image forming processing, the sheet being held on the first surface 411 of the conveyance belt 41. In the present embodiment, the image forming unit 50, which is of ink jet type as an image forming method, discharges ink drops to form an image on the sheet S.

Figure 2:
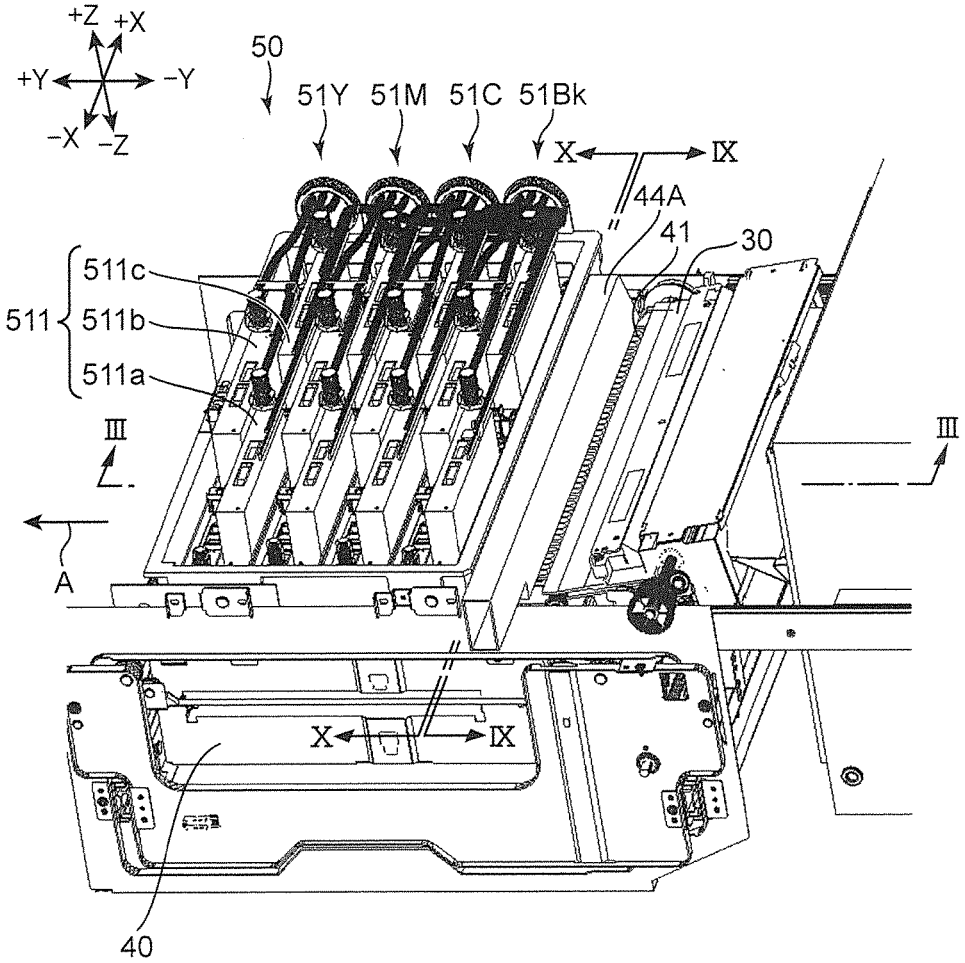
FIG. 2 is a perspective view showing an enlarged vicinity of the sheet conveyance device and an image forming unit.
Figure 3:
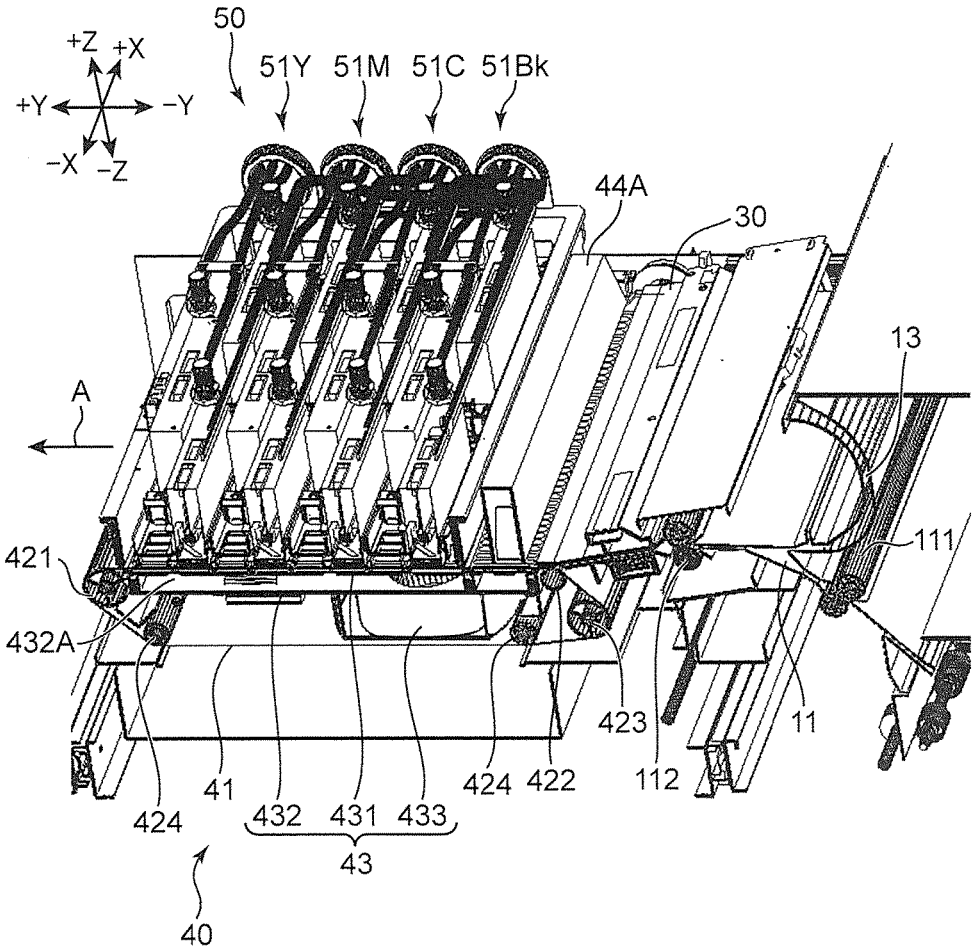
FIG. 3 is a perspective view of a state of the sheet conveyance device and the image forming unit in FIG. 2 which are taken along a line III-III.
Figure 4:
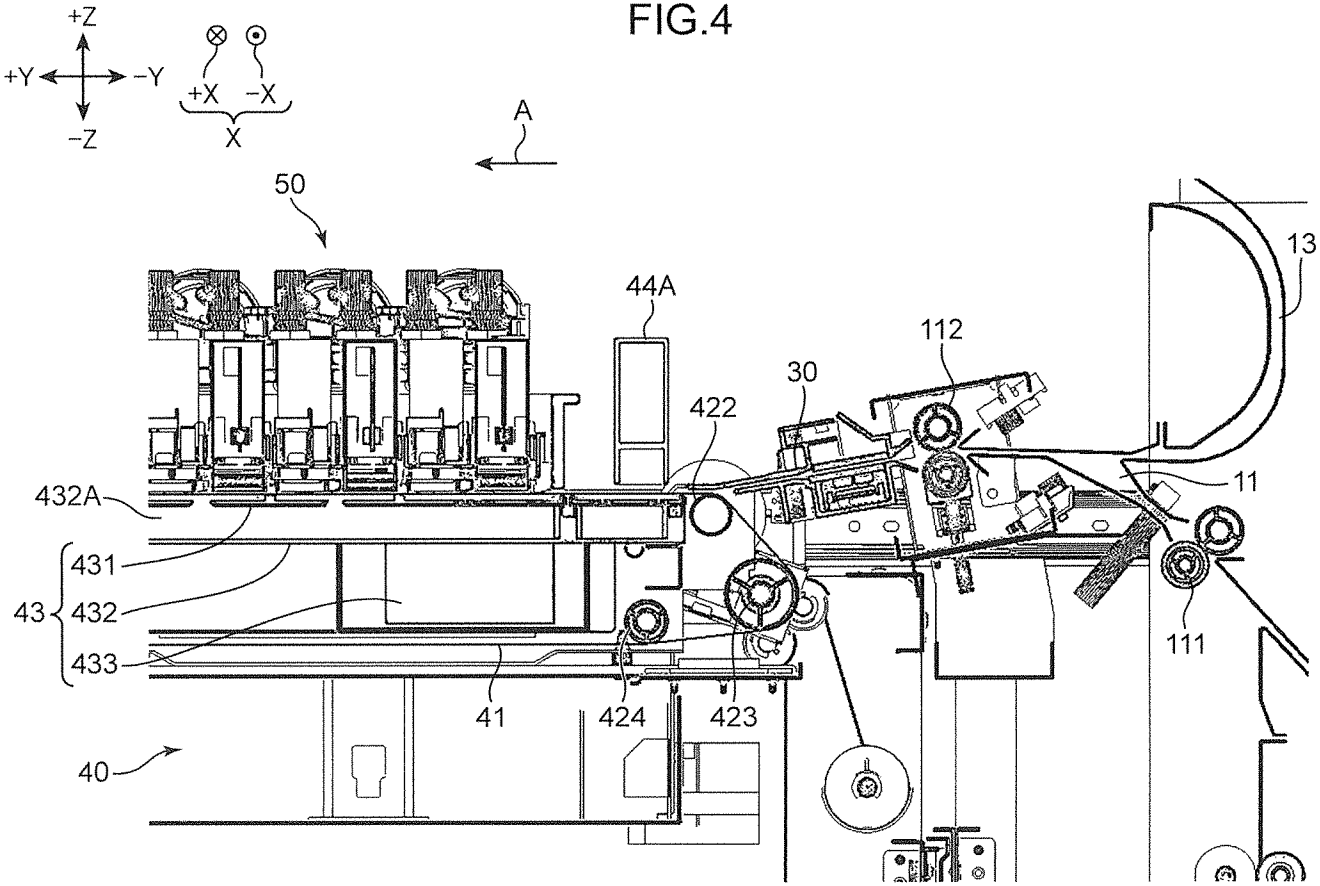
FIG. 4 is a sectional view of a vicinity of the sheet conveyance device and the image forming unit.

With reference to FIG. 2 to FIG. 4 in addition to FIG. 1, the image forming unit 50 will be described. FIG. 2 is a perspective view showing an enlarged vicinity of the sheet conveyance device 40 and the image forming unit 50. FIG. 3 is a perspective view of a state of the sheet conveyance device 40 and the image forming unit 50 in FIG. 2 which are taken along a line III-III. FIG. 4 is a sectional view of a vicinity of the sheet conveyance device 40 and the image forming unit 50.

The image forming unit 50 includes line heads 51Bk, 51C, 51M, and 51Y. The line head 51Bk discharges black ink drops, the line head 51C discharges cyan ink drops, the line head 51M discharges magenta ink drops, and the line head 51Y discharges yellow ink drops. The line heads 51Bk, 51C, 51M, and 51Y are provided in parallel to each other from an upstream side toward a downstream side in the sheet conveyance direction A. Since the line heads 51Bk, 51C, 51M, and 51Y have the same configuration except for color of ink drops to be discharged, the heads are collectively referred to as a line head 51 in some cases.

The line head 51 discharges ink drops to the sheet S conveyed in the sheet conveyance direction A to form an image on the sheet S, the sheet being held on the first surface 411 of the conveyance belt 41. In detail, the line head 51 discharges ink drops toward the sheet S being passed by the conveyance belt 41 through a position opposed to the line head 51. This results in forming an image on the sheet S.

The line head 51 is configured with a first recording head 511*a*, a second recording head 511*b*, and a third recording head 511*c* as shown in FIG. 2. The first recording head 511*a*, the second recording head 511*b*, and the third recording head 511*c* are disposed in a zigzag manner along the X direction (the front-rear direction) orthogonal to the sheet conveyance direction A. The X direction (the front-rear direction) as a direction in which the first recording head 511*a*, the second recording head 511*b*, and the third recording head 511*c* are disposed is coincide with a width direction of the conveyance belt 41. Additionally, since the first recording head 511*a*, the second recording head 511*b*, and the third recording head 511*c* have the same configuration, the heads are collectively referred to as a recording head 511. The recording head 511 discharges ink drops to the sheet S conveyed by the conveyance belt 41 from a nozzle hole corresponding to a printing position.

The sheet S, on which an image is formed by ink drops discharged from the nozzle hole of the recording head 511 configuring the line head 51, is conveyed by the conveyance belt 41 and is sent to the second conveyance path 12 provided to extend on the downstream side in the sheet conveyance direction A of the conveyance belt 41.

The sheet S sent to the second conveyance path 12 is conveyed toward a sheet ejection port 12A formed on the +Y side (the left side) of the apparatus main body 10 by a pair of second conveyance rollers 121 provided on the second conveyance path 12, and discharged from the sheet ejection port 12A onto the sheet ejection tray 60.

On the other hand, when the sheet S sent to the second conveyance path 12 is for double-sided printing and has one side finished with the image forming processing, the sheet S is brought into a state of being sandwiched between the pair of second conveyance rollers 121. In this state, reverse rotation of the pair of second conveyance rollers 121 switches back the sheet S. As a result, the sheet S is sent to the third conveyance path 13. The sheet S sent to the third conveyance path 13 is reversely sent by a pair of third conveyance rollers 131 provided on the third conveyance path 13 and is again supplied onto the first surface 411 of the conveyance belt 41 via the pair of resist rollers 112 and the guide unit 30, the sheet being reversed upside down. While being transported by the conveyance belt 41, the sheet S supplied upside down onto the first surface 411 of the conveyance belt 41 has a back face side subjected to the image forming processing by the image forming unit 50. The sheet S whose both side printing is completed is passed through the second conveyance path 12 and discharged from the sheet ejection port 12A onto the sheet ejection tray 60.

[Detailed Configuration of Sheet Conveyance Device]

Figure 5:
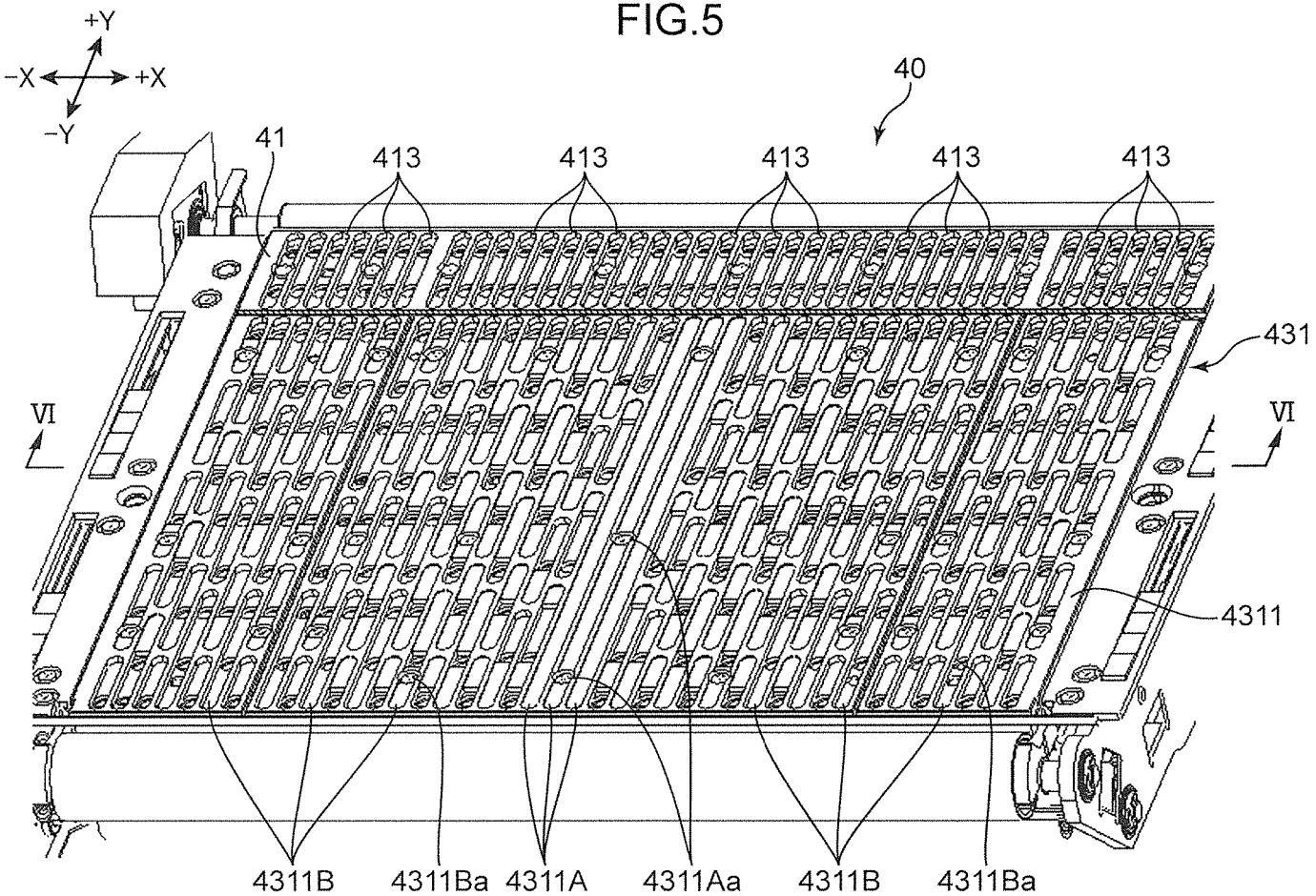
FIG. 5 is a perspective view for explaining configurations of a conveyance belt and a belt guiding member of a suction unit provided in the sheet conveyance device.
Figure 6:
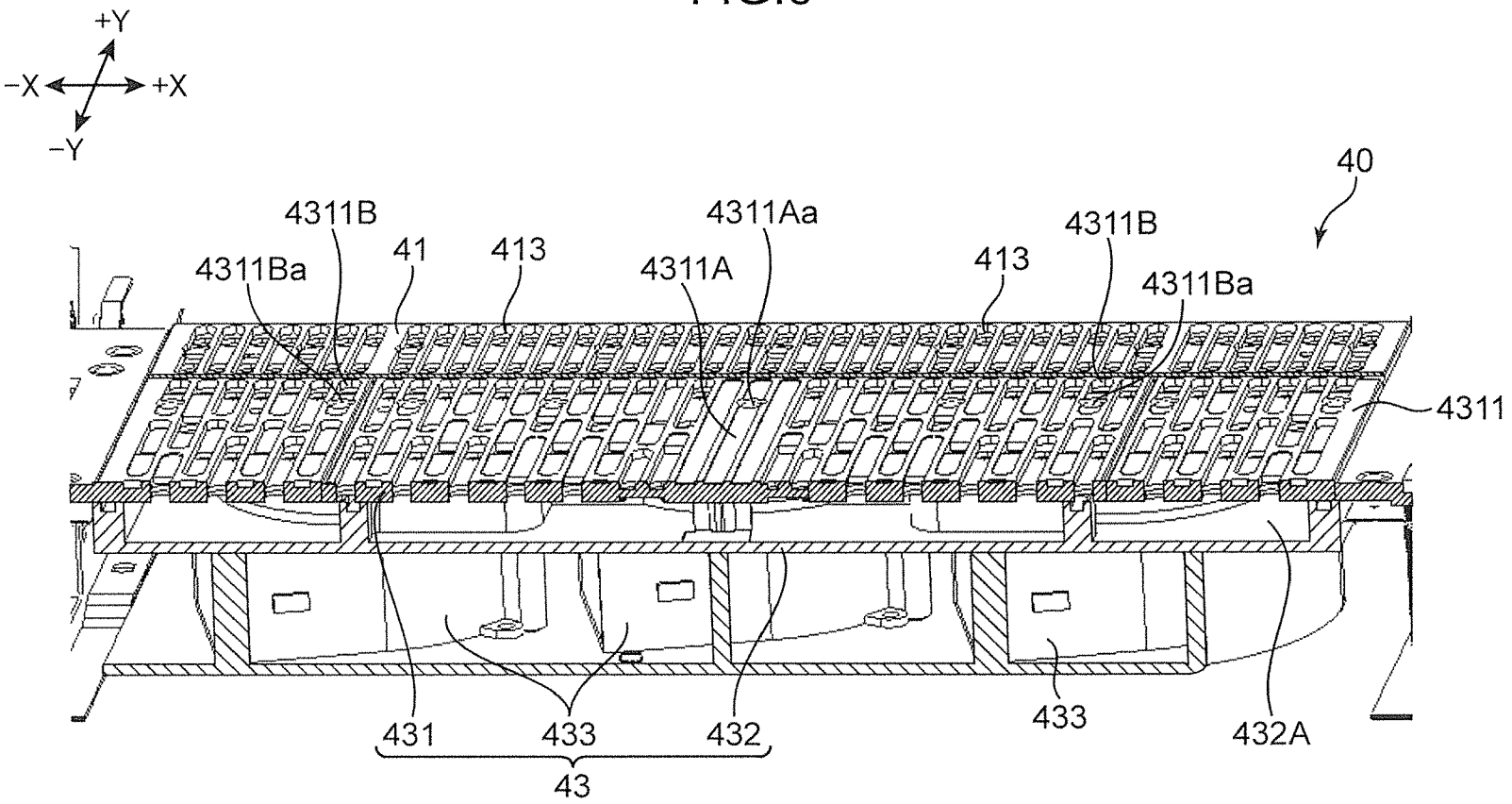
FIG. 6 is a perspective view of a state of the conveyance belt and the belt guiding member in FIG. 5 which are taken along a line VI-VI.
Figure 7:
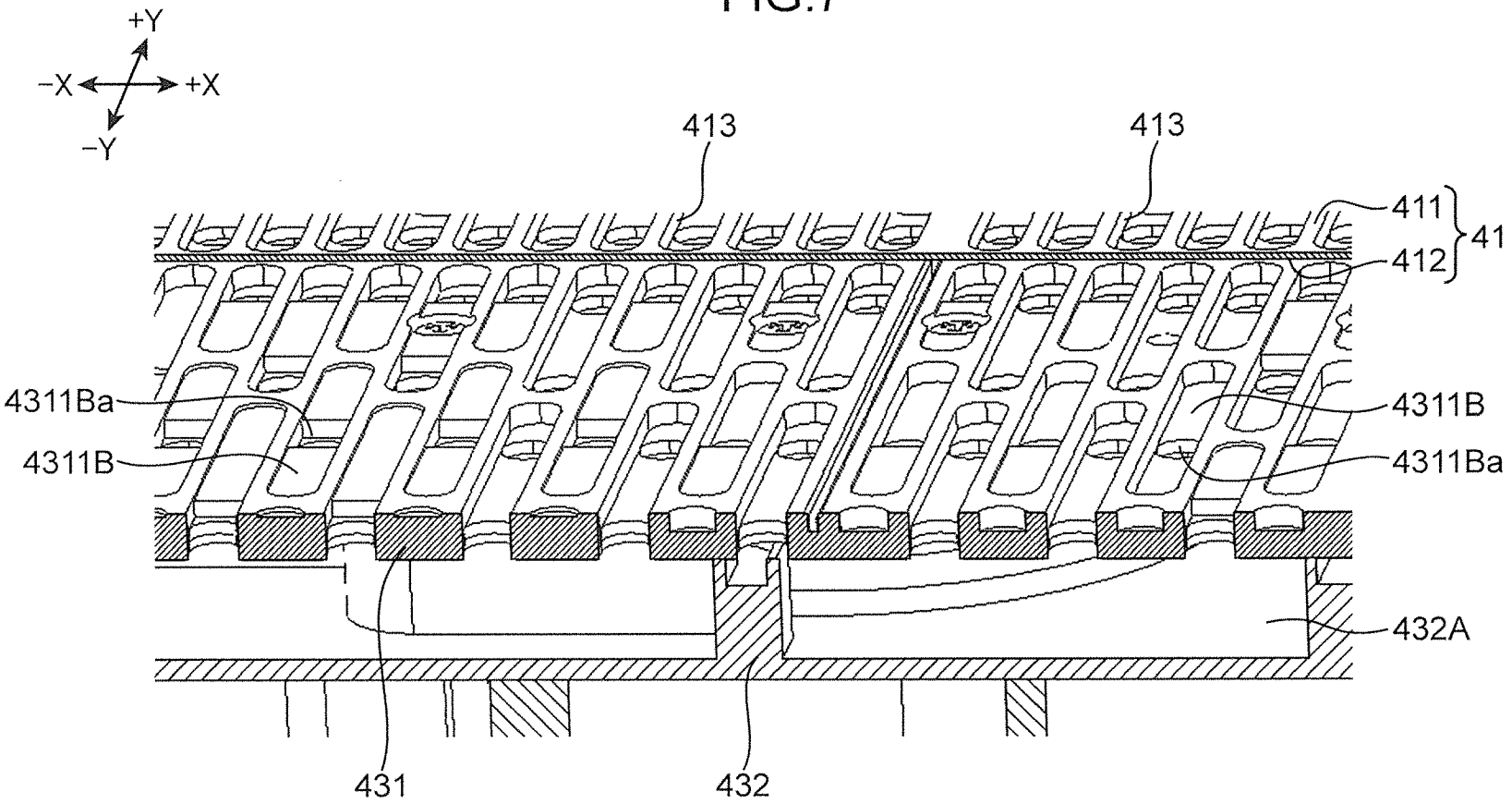
FIG. 7 is a perspective view showing an enlarged part of FIG. 6.
Figure 8:
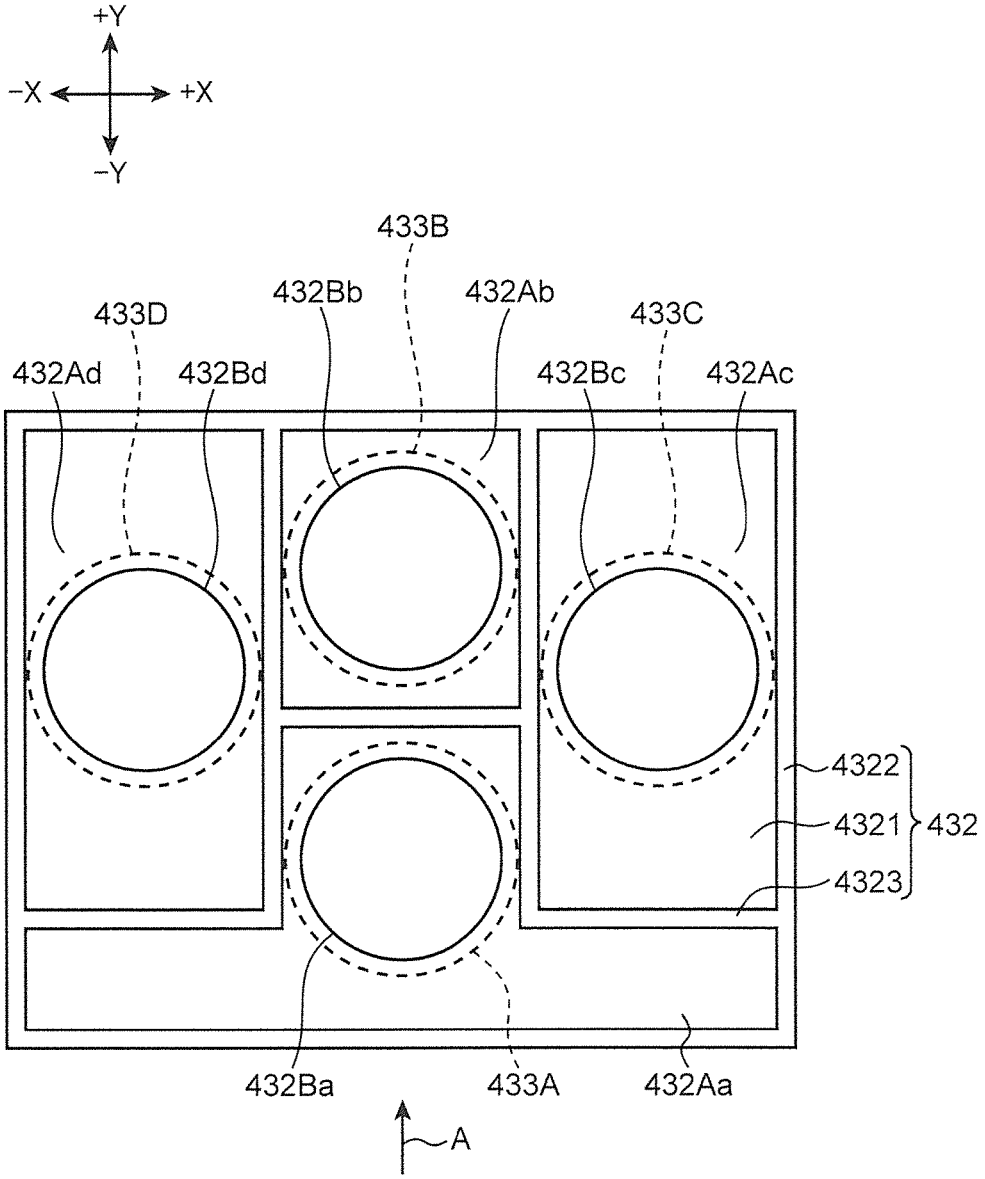
FIG. 8 is a view of a suction unit provided in the sheet conveyance device seen from above.
Figure 9:
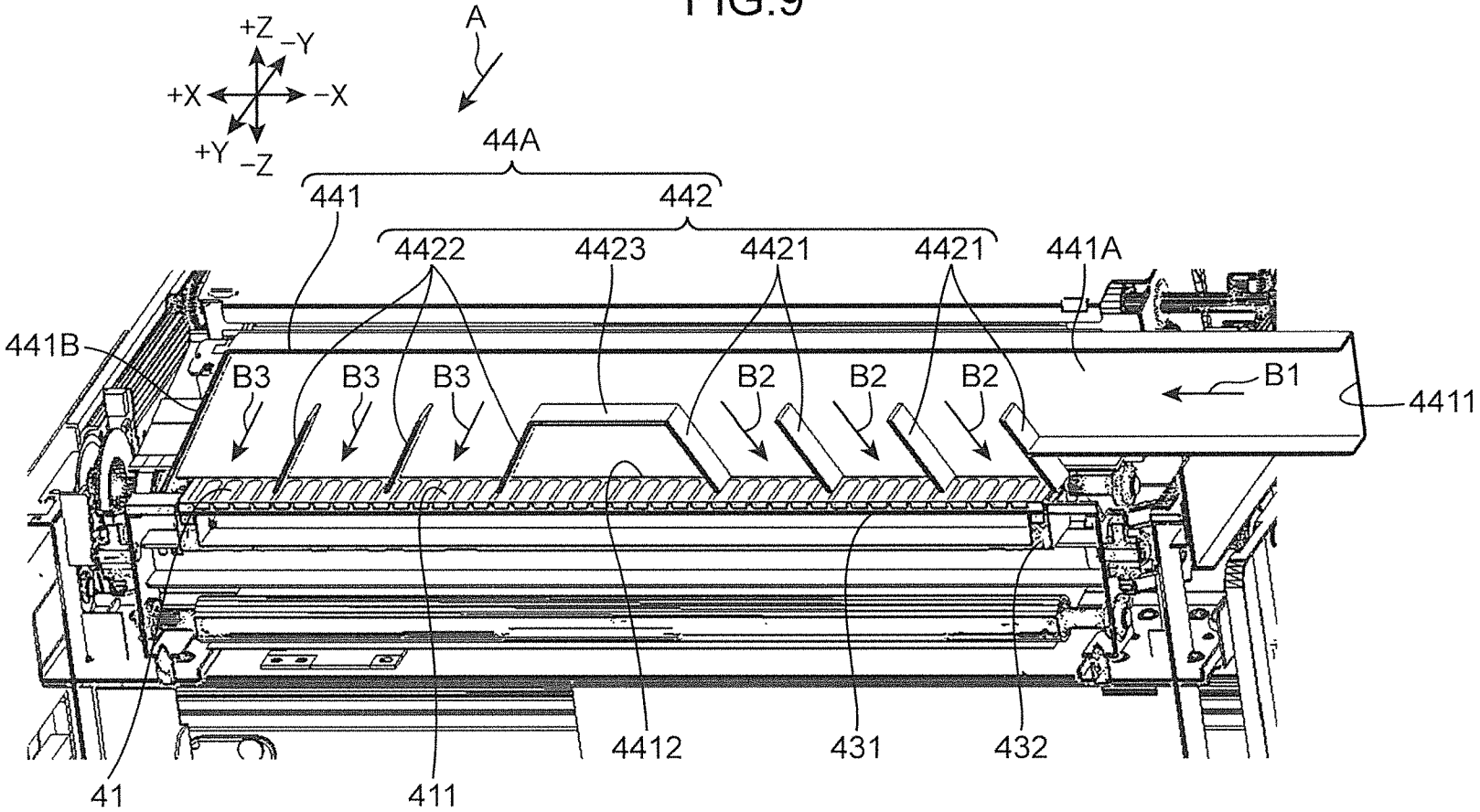
FIG. 9 is a view for explaining a configuration of a ventilation duct in a ventilation unit provided in the sheet conveyance device, which is a perspective view of a state taken along a line IX-IX in FIG. 2.
Figure 10:
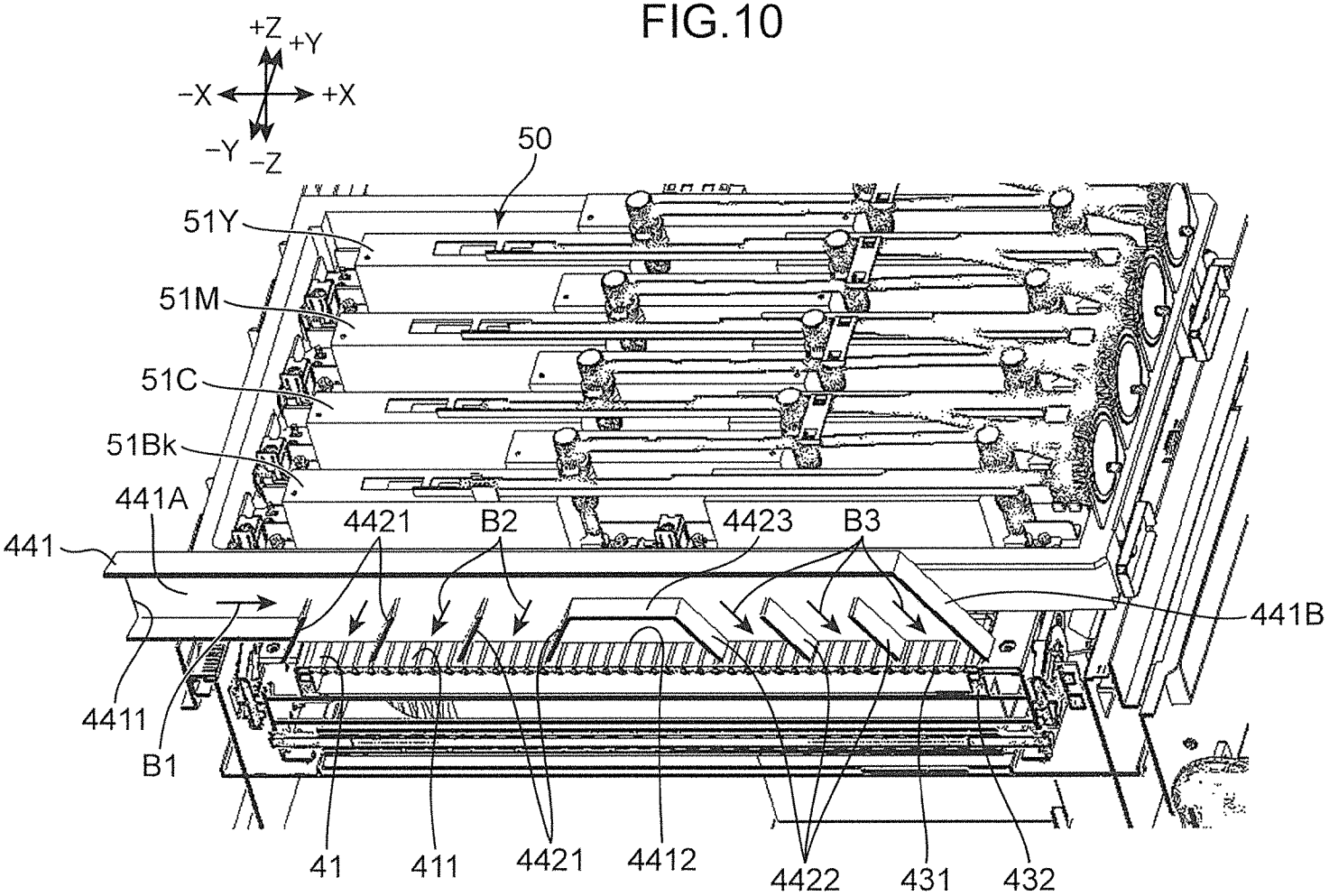
FIG. 10 is a view for explaining a configuration of the ventilation duct, which is a perspective view of a state taken along a line X-X in FIG. 2.

Next, a configuration of the sheet conveyance device 40 will be described in detail with reference to FIG. 5 to FIG. 10 in addition to FIG. 1 to FIG. 4. FIG. 5 is a perspective view for explaining configurations of the conveyance belt 41 and a belt guiding member 431 of a suction unit 43 provided in the sheet conveyance device 40. FIG. 6 is a perspective view of a state of the conveyance belt 41 and the belt guiding member 431 in FIG. 5 which are taken along a line VI-VI. FIG. 7 is a perspective view showing an enlarged part of FIG. 6. FIG. 8 is a view of the suction unit 43 provided in the sheet conveyance device 40 seen from above. FIG. 9 is a view for explaining a configuration of a ventilation duct 44A in a ventilation unit 44 provided in the sheet conveyance device 40, which is a perspective view of a state taken along a line IX-IX in FIG. 2. FIG. 10 is a view for explaining a configuration of the ventilation duct 44A, which is a perspective view of a state taken along a line X-X in FIG. 2.

The sheet conveyance device 40 is arranged at a −Z side (a lower side) of the image forming unit 50 so as to be opposed to the line head 51. The sheet conveyance device 40 conveys the sheet S toward the image forming unit 50 in the sheet conveyance direction A, the sheet being sent by the pair of resist rollers 112 and guided by the guide unit 30 so as to be supplied. The sheet conveyance device 40 includes the conveyance belt 41, the suction unit 43, and the ventilation unit 44.

The conveyance belt 41 is an endless belt having a width in the X direction (the front-rear direction) and extending in the Y direction (the right and left direction). The conveyance belt 41 has the first surface 411 and a second surface 412 on the side opposite to the first surface 411 and is arranged so as to be opposed to the image forming unit 50 to convey the sheet S on the first surface 411 in the sheet conveyance direction A. More specifically, the conveyance belt 41 conveys the sheet S in the sheet conveyance direction A while holding the sheet S on the first surface 411 within a predetermined conveyance region opposed to the line head 51 of the image forming unit 50. Here, on the conveyance belt 41 as an endless belt, the first surface 411 is an outer circumference surface and the second surface 412 is an inner circumference surface.

The conveyance belt 41 extends between a first roller 421, a second roller 422, a third roller 423, and a pair of fourth rollers 424 as shown in FIG. 1. Inside the extended conveyance belt 41, the suction unit 43 is arranged so to be opposed to the second surface 412.

The first roller 421 is a drive roller extending in the X direction which is a width direction of the conveyance belt 41 and is arranged downstream of the suction unit 43 in the sheet conveyance direction A. The first roller 421 is driven to rotate by a motor not shown, thereby rotating the conveyance belt 41 in a predetermined rotation direction. Rotation of the conveyance belt 41 causes the sheet S held on the first surface 411 to be conveyed in the sheet conveyance direction A.

The second roller 422, which is a belt speed sensing roller extending along the X direction, is arranged upstream of the suction unit 43 in the sheet conveyance direction A. The second roller 422 is arranged so as to maintain, in cooperation with the first roller 421, flatness in a region of the first surface 411 of the conveyance belt 41 opposed to the line head 51 and a region of the second surface 412 of the conveyance belt 41 opposed to the suction unit 43. Here, on the first surface 411 of the conveyance belt 41, a region opposed to the line head 51 and between the first roller 421 and the second roller 422 serves as the predetermined conveyance region for holding and conveying the sheet S. The second roller 422 is driven to rotate in conjunction with rotation of the conveyance belt 41. To the second roller 422, a pulse plate not shown is attached so as to be rotated integrally with the second roller 422. By measuring a rotation speed of the pulse plate, a rotation speed of the conveyance belt 41 is sensed.

The third roller 423, which is a tension roller extending along the X direction, applies tension to the conveyance belt 41 so as to prevent the conveyance belt 41 from loosening. The third roller 423 is driven to rotate in conjunction with rotation of the conveyance belt 41. The pair of fourth rollers 424, each of which is a guide roller extending along the X direction, guides the conveyance belt 41 such that the conveyance belt 41 passes on the −Z side (the lower side) of the suction unit 43. The pair of fourth rollers 424 is driven to rotate in conjunction with rotation of the conveyance belt 41.

Additionally, as shown in FIG. 5 to FIG. 7, the conveyance belt 41 has a plurality of suction holes 413 (through holes) which extends through a thickness direction from the first surface 411 to the second surface 412. In FIG. 5 to FIG. 7, a region part of the conveyance belt 41 on the −Y side (the right side) is notched so as to enable a surface state to be recognized of the belt guiding member 431 of the suction unit 43 to be described later. In the conveyance belt 41, each of the plurality of suction holes 413 has a shape of a long hole extending along the Y direction and is disposed in the Y direction and the X direction.

The suction unit 43 is arranged opposed to the image forming unit 50 with the conveyance belt 41 provided therebetween. In more detail, the suction unit 43 is arranged inside the conveyance belt 41 extending between the first roller 421, the second roller 422, the third roller 423, and the pair of fourth rollers 424 so as to be opposed to the second surface 412. By generating a negative pressure between the sheet S in close contact with the first surface 411 of the conveyance belt 41 and the conveyance belt 41 by the ventilation unit 44 to be described later, the suction unit 43 brings the sheet S into close contact with the first surface 411 of the conveyance belt 41. As a result, the sheet S is held on the first surface 411 of the conveyance belt 41. The suction unit 43 includes the belt guiding member 431, a suction casing 432, a suction device 433, and an exhaust duct 434.

In the suction unit 43, the belt guiding member 431 is a plate-shaped member having a width size substantially the same as a length of the conveyance belt 41 in the width direction (the X direction) and arranged on the second surface 412 of the conveyance belt 41 so as to be opposed to a region between the first roller 421 and the second roller 422. The belt guiding member 431 forms an upper face portion of the suction casing 432 and has a shape substantially the same as that of the suction casing 432 when viewed from the +Z side (the upper side). The belt guiding member 431, between the first roller 421 and the second roller 422, guides circular movement of the conveyance belt 41 in conjunction with rotation of the first roller 421.

Additionally, as shown in FIG. 5 to FIG. 7, the belt guiding member 431 has a plurality of first grooves 4311A and second grooves 4311B formed on a belt guide surface 4311 opposed to the second surface 412 of the conveyance belt 41. Each of the first grooves 4311A is a groove portion formed in a center part of the belt guide surface 4311 in a width direction (the X direction) of the belt guiding member 431 so as to correspond to the suction holes 413 formed in a center part of the conveyance belt 41 in the width direction. Each first groove 4311A is a long groove extending over both end portions of the belt guide surface 4311 in the Y direction of the belt guiding member 431. In the present embodiment, as shown in FIG. 5, three first grooves 4311A extending in parallel to each other in the Y direction are disposed in the width direction.

Each second grooves 4311B is groove portion formed on both end portion sides of the first grooves 4311A formed in the center part in the width direction of the belt guide surface 4311 of the belt guiding member 431 to correspond to the suction holes 413 formed on both end portion sides relative of the center part of the conveyance belt 41 in the width direction. Each second groove 4311B is a long groove extending in a length shorter than the first groove 4311A along the Y direction on the belt guide surface 4311 of the belt guiding member 431. In the present embodiment, as shown in FIG. 5, in regions on both end portion sides of the first groove 4311A formed in the center part of the width direction of the belt guide surface 4311 of the belt guiding member 431, the second grooves 4311B are disposed along the Y direction and the X direction.

Further, the belt guiding member 431 has first through holes 4311Aa provided corresponding to the respective first grooves 4311A and second through holes 4311Ba provided corresponding to the respective second grooves 4311B. The first through holes 4311Aa are hole portions extending through the first groove 4311A in a thickness direction of the belt guiding member 431 and communicate with the suction holes 413 formed in the center part of the conveyance belt 41 in the width direction via the first groove 4311A. Additionally, the second through holes 4311Ba are hole portions extending through the second groove 4311B in the thickness direction of the belt guiding member 431 and communicate with the suction holes 413 formed on both end portion sides in the width direction relative to the center part of the conveyance belt 41 via the second grooves 4311B. Here, on the belt guide surface 4311 of the belt guiding member 431, the number of the second through holes 4311Ba per unit area is set to be larger than the number of the first through holes 4311Aa per unit area. Specifically, the number of the through holes on the belt guide surface 4311 of the belt guiding member 431 is set to be larger in a region on both end portion sides than in the center part in the width direction.

The suction unit 43 having thus configured belt guiding member 431 generates a suction force by sucking air from a space on the +Z side (the upper side) of the conveyance belt 41 via the first grooves 4311A and the second grooves 4311B and the first through holes 4311Aa and the second through holes 4311Ba of the belt guiding member 431, and the suction holes 413 of the conveyance belt 41. This suction force generates an air stream (suction wind) in a space above the conveyance belt 41, the air stream being directed to the suction unit 43. When the sheet S is guided onto the conveyance belt 41 by the guide unit 30 to cover a part of the first surface 411 of the conveyance belt 41, a suction force (negative pressure) acts on the sheet S, so that the sheet S is brought into close contact with the first surface 411 of the conveyance belt 41.

Here, as described above, the number of the through holes on the belt guide surface 4311 of the belt guiding member 431, the through holes communicating with the suction holes 413 of the conveyance belt 41, is set such that the number of the second through holes 4311Ba formed in a region on both end portion sides is larger than the number of the first through holes 4311Aa formed in the center part in the width direction (the X direction). Thus, a suction force (negative pressure) acting on the sheet S on the first surface 411 of the conveyance belt 41 is larger in the regions on both end portion sides than in the center part in the width direction. As a result, the sheet S can be evenly brought into close contact with the conveyance belt 41 in the width direction thereof.

In the suction unit 43, the suction casing 432, which is a box-shaped casing with the +Z side (the upper side) opened, is arranged on the −Z side (the lower side) of the conveyance belt 41 such that the opening on the +Z side is covered by the belt guiding member 431 which forms the upper face portion of the suction casing 432. The suction casing 432 defines a suction space 432A in cooperation with the belt guiding member 431 configuring the upper face portion of the suction casing. In other words, a space surrounded by the suction casing 432 and the belt guiding member 431 serves as the suction space 432A. The suction space 432A communicates with the suction holes 413 of the conveyance belt 41 via the first grooves 4311A and the second grooves 4311B, and the first through holes 4311Aa and the second through holes 4311Ba of the belt guiding member 431.

With reference to FIG. 8, the suction casing 432 will be detailed, in which the suction casing 432 is configured to include a rectangular plate-shaped bottom wall portion 4321, a side wall portion 4322 vertically arranged in an outer circumferential end portion of the bottom wall portion 4321, and a partition wall portion 4323 vertically arranged in the bottom wall portion 4321 to zone the suction space 432A into a plurality of regions. On an upper end portion of the side wall portion 4322 in the suction casing 432, the belt guiding member 431 is arranged so as to be opposed to the bottom wall portion 4321. In the present embodiment, the partition wall portion 4323 zones the suction space 432A into a first space 432Aa, a second space 432Ab, a third space 432Ac, and a fourth space 432Ad.

The first space 432Aa, which is a region on the upstream side in the sheet conveyance direction A in the suction space 432A, is a space extending between both end portions in a width direction (the X direction) of the suction casing 432 and protruding, in a center part in the width direction, to +Y side (the left side). In the suction space 432A, the second space 432Ab, which is a region located downstream of the first space 432Aa in the sheet conveyance direction A, is a space, in the center part in the width direction of the suction casing 432, adjacent to the downstream side of the first space 432Aa in the sheet conveyance direction A.

In the suction space 432A, the third space 432Ac is a region located downstream of the first space 432Aa in the sheet conveyance direction A, and located more to the +X side (a rear side) than the second space 432Ab. Specifically, the third space 432Ac is a space which on the +X side in the width direction of the suction casing 432, is adjacent to the downstream side of the first space 432Aa in the sheet conveyance direction A, and is adjacent to the +X side of the second space 432Ab. Additionally, in the suction space 432A, the fourth space 432Ad is a region downstream of the first space 432Aa in the sheet conveyance direction A and located more to a −X side (the front side) than the second space 432Ab. Specifically, the fourth space 432Ad is a space, on the −X side in the width direction of the suction casing 432, adjacent to the downstream side of the first space 432Aa in the sheet conveyance direction A and adjacent to the −X side of the second space 432Ab.

Further, in the bottom wall portion 4321 of the suction casing 432, a first opening portion 432Ba is formed in the first space 432Aa zoned by the partition wall portion 4323, a second opening portion 432Bb is formed in the second space 432Ab, a third opening portion 432Bc is formed in the third space 432Ac, and a fourth opening portion 432Bd is formed in the fourth space 432Ad. Then, on the −Z side (the lower side) of the bottom wall portion 4321 of the suction casing 432, a first suction device 433A is arranged corresponding to the first opening portion 432Ba, a second suction device 433B is arranged corresponding to the second opening portion 432Bb, a third suction device 433C is arranged corresponding to the third opening portion 432Bc, and a fourth suction device 433D is arranged corresponding to the fourth opening portion 432Bd.

The first suction device 433A, the second suction device 433B, the third suction device 433C, and the fourth suction device 433D are connected to the suction space 432A via the first opening portion 432Ba, the second opening portion 432Bb, the third opening portion 432Bc, and the fourth opening portion 432Bd, respectively. Additionally, to each of the first suction device 433A, the second suction device 433B, the third suction device 433C, and the fourth suction device 433D, the exhaust duct 434 is connected as shown in FIG. 1. The exhaust duct 434 is coupled to an exhaust port not shown which is provided in the apparatus main body 10.

The first suction device 433A, the second suction device 433B, the third suction device 433C, and the fourth suction device 433D are suction fans but not limited to suction fans, and may be, for example, vacuum pumps. Drive of the first suction device 433A, the second suction device 433B, the third suction device 433C, and the fourth suction device 433D generate negative pressures in the first space 432Aa, the second space 432Ab, the third space 432Ac, and the fourth space 432Ad, respectively, in the suction casing 432. The negative pressure generates a suction force in the first groove 4311A and the second groove 4311B via the first through hole 4311Aa and the second through hole 4311Ba of the belt guiding member 431, and via the first groove 4311A and the second groove 4311B, a suction force is generated in the suction holes 413 of the conveyance belt 41. As a result, air from the space on the +Z side (the upper side) of the conveyance belt 41 is sucked into each of the first space 432Aa, the second space 432Ab, the third space 432Ac, and the fourth space 432Ad in the suction casing 432.

The air sucked in each of the first space 432Aa, the second space 432Ab, the third space 432Ac, and the fourth space 432Ad in the suction casing 432 is exhausted via the exhaust duct 434 connected to the respective first suction device 433A, second suction device 433B, third suction device 433C, and fourth suction device 433D. Then, when the sheet S is guided onto the conveyance belt 41 by the guide unit 30 to cover a part of the first surface 411 of the conveyance belt 41 and cover a part of the plurality of suction holes 413, a suction force (negative pressure) from the suction holes 413 blocked by the sheet S acts on the sheet S, so that the sheet S is brought into close contact with the first surface 411 of the conveyance belt 41. Here, since the suction space 432A in the suction casing 432 is zoned by the partition wall portion 4323 into the first space 432Aa, the second space 432Ab, the third space 432Ac, and the fourth space 432Ad, and the first suction device 433A, the second suction device 433B, the third suction device 433C, and the fourth suction device 433D arranged corresponding to the respective zoned spaces suck air, the entire surface of the sheet S can be evenly brought into close contact with the first surface 411 of the conveyance belt 41.

Next, mainly with reference to FIG. 1, FIG. 9, and FIG. 10, the ventilation unit 44 provided in the sheet conveyance device 40 will be described. On the upstream side in the sheet conveyance direction A of the image forming unit 50, the ventilation unit 44 blows out air toward the sheet S to bring the sheet S into close contact with or adhere the same to the first surface 411 of the conveyance belt 41. By generating a negative pressure between the sheet S being in close contact with or adhered to the first surface 411 by the ventilation unit 44 and the conveyance belt 41, the above suction unit 43 brings the sheet S into close contact with the first surface 411 of the conveyance belt 41. The ventilation unit 44 includes the ventilation duct 44A and a ventilator 44B.

The ventilation duct 44A is a duct arranged in the predetermined conveyance region between the first roller 421 and the second roller 422 on the first surface 411 of the conveyance belt 41 and opposed to a region upstream of the image forming unit 50 in the sheet conveyance direction A. The ventilation duct 44A includes a duct main body 441 and a wind direction adjustment unit 442.

The duct main body 441 is a box-shaped tubular body configuring a main body portion of the ventilation duct 44A and extending along the width direction (the X direction) of the conveyance belt 41 so as to form a ventilation space 441A which serves as an air ventilation flow path. The duct main body 441 has an air introduction port 4411 formed at an end portion on the −X side (the front side) in the X direction as the extension direction thereof, and a blowoff port 4412 opened facing the first surface 411 of the conveyance belt 41 to blow out air toward the first surface 411. The blowoff port 4412 is an opening portion opened across both end portions in the width direction of the conveyance belt 41.

The ventilation duct 44A blows out, from the blowoff port 4412, the air introduced from the air introduction port 4411 into a ventilation space 441A of the duct main body 441, toward the first surface 411 of the conveyance belt 41. In the present embodiment, the air introduced from the air introduction port 4411 of the duct main body 441 into the ventilation space 441A is air generated by the ventilator 44B. Specifically, the ventilation duct 44A blows out the air from the blowoff port 4412 toward the first surface 411 of the conveyance belt 41, the air being generated by the ventilator 44B and introduced from the air introduction port 4411 into the ventilation space 441A of the duct main body 441.

With the exhaust duct 434 of the suction unit 43 connected to the air introduction port 4411, air exhausted via the exhaust duct 434 may be introduced from the air introduction port 4411 into the ventilation space 441A of the duct main body 441. In this case, the ventilation duct 44A blows out the air toward the first surface 411 of the conveyance belt 41 from the blowoff port 4412, the air being exhausted from the exhaust duct 434 and introduced into the ventilation space 441A of the duct main body 441 from the air introduction port 4411. This enables effective use of the air exhausted from the exhaust duct 434 without separately providing the ventilator 44B.

In this case, however, a blowing force of air to the sheet S, the air being blown out from the blowoff port 4412 of the ventilation duct 44A, changes with a volume of exhausted air from the exhaust duct 434. The volume of air exhausted from the exhaust duct 434 decreases as a ratio of the first surface 411 of the conveyance belt 41 covered with the sheet S increases. In other words, a blowing force of the air to the sheet S, the air being blown out from the blowoff port 4412 of the ventilation duct 44A, is large until just before the front end portion of the sheet S conveyed by the conveyance belt 41 reaches the image forming unit 50, and thereafter decreases.

In the sheet conveyance device 40 provided with the ventilation unit 44 having the ventilation duct 44A, the sheet S is brought into close contact with the conveyance belt 41 by a negative pressure generated by the suction unit 43 while having the sheet S be in close contact with the conveyance belt 41 by air blow from the blowoff port 4412 of the duct main body 441 toward the first surface 411 of the conveyance belt 41, or even before reaching a close contact state, while bringing the sheet S close to or adhering the same to the conveyance belt 41 by a wind pressure. In other words, the wind pressure of the air blown out from the blowoff port 4412 of the ventilation duct 44A assists the suction unit 43 in bringing the sheet S into close contact with the conveyance belt 41. Even when the front end portion of the sheet S guided by the guide unit 30 and supplied to the conveyance belt 41 deforms such as undulation, this prevents formation of a gap between the front end portion of the sheet S and the conveyance belt 41, thereby suppressing a failure in close contact of the sheet S with the conveyance belt 41. Accordingly, in the sheet conveyance device 40, the conveyance belt 41 is allowed to have excellent property of conveying the sheet S.

Additionally, paper powder may be attached to the front end portion of the sheet S in some cases. When the sheet S is conveyed by the conveyance belt 41 with paper powder attached to the front end portion thereof, the paper powder might be attached to the recording head 511 of the image forming unit 50 arranged to be opposed to the first surface 411 of the conveyance belt 41, so that the nozzle hole of the recording head 511 might clog. To cope with the problem, in the sheet conveyance device 40 of the present embodiment, since air is blown out from the blowoff port 4412 of the ventilation duct 44A toward the first surface 411 of the conveyance belt 41, the air blow enables removal of paper powder attached to the front end portion of the sheet S. Therefore, it is possible to suppress attaching of paper powder to the recording head 511 of the image forming unit 50 as much as possible.

The paper powder removed from the front end portion of the sheet S scatters on an upper face of the sheet S, from the center to an end portion of the sheet. This prevents paper powder from attaching to the conveyance belt 41 as much as possible. Even if paper powder is attached to the conveyance belt 41, the paper powder enters the first space 432Aa of the suction casing 432 via the suction holes 413 of the conveyance belt 41, the first through holes 4311Aa, and the second through holes 4311Ba of a belt guiding member 431 by an air flow blown out from the blowoff port 4412 of the ventilation duct 44A. Thereafter, the paper powder is collected by a filter or the like which is attached to the exhaust duct 434 connected to the first suction device 433A.

Additionally, in the sheet conveyance device 40 of the present embodiment, the suction unit 43 is configured to bring the sheet S into close contact with the conveyance belt 41 by sucking air via the suction holes 413 of the conveyance belt 41. On the other hand, as described above, air blown out from the blowoff port 4412 of the ventilation duct 44A toward the conveyance belt 41 can assist the suction unit 43 in bringing the sheet S into close contact with the conveyance belt 41. It is therefore possible to broaden options for air sucking performance in the suction unit 43 and to use, for example, a versatile suction fan having relatively low air sucking performance (low maximum static pressure) as the first to fourth suction devices 433A, 433B, 433C, and 433D of the suction unit 43.

Additionally, the ventilation duct 44A includes the wind direction adjustment unit 442. The wind direction adjustment unit 442 is arranged in the ventilation space 441A of the duct main body 441 and adjusts a direction of wind such that air blown out from the blowoff port 4412 spreads from the center part of the conveyance belt 41 in the width direction (the X direction) toward both end portions, in other words, deviates from the center part in the width direction toward both end portions. Specifically, the wind direction adjustment unit 442 is configured to include first deflector plates 4421 and second deflector plates 4422 which zone the blowoff port 4412 of the duct main body 441 into a plurality of regions aligned in the width direction of the conveyance belt 41.

In the present embodiment, as shown in FIG. 9 and FIG. 10, on the −X side (the front side) with respect to the center part of the conveyance belt 41 in the width direction, the plurality of first deflector plates 4421 is arranged in parallel to each other along the width direction, and on the +X side (the rear side) with respect to the center part of the conveyance belt 41 in the width direction, the plurality of second deflector plates 4422 is arranged in parallel to each other along the width direction.

Then, each of the plurality of first deflector plates 4421 slants from the center part of the conveyance belt 41 in the width direction toward a −X side end portion and is provided to extend toward a bottom side (the −Z side)(toward the blowoff port 4412) closer to the first surface 411. Additionally, each of the plurality of second deflector plates 4422 slants from the center part of the conveyance belt 41 in the width direction toward a +X side end portion and is provided to extend toward the bottom side closer to the first surface 411. An end wall portion 441B slants similarly to the second wind direction adjustment plate 4422, the end wall portion 441B defining the +X side end portion of the duct main body 441 in the X direction.

In the ventilation duct 44A provided with the wind direction adjustment unit 442 configured to include the first deflector plates 4421 and the second deflector plates 4422, air, which is introduced from the air introduction port 4411 into the ventilation space 441A of the duct main body 441 to flow along an arrow B1 direction from the −X side to the +X side, has a wind direction thereof, on the −X side with respect to the center part of the conveyance belt 41 in the width direction, adjusted to an arrow B2 direction along the first deflector plates 4421, and on the +X side relative to the center part of the conveyance belt 41 in the width direction, adjusted to an arrow B3 direction along the second deflector plates 4422. Then, from the region zoned by the first deflector plates 4421 of the blowoff port 4412, air is blown out which spreads from the center part of the conveyance belt 41 in the width direction toward the −X side end portion, and from the region zoned by the second deflector plates 4422 of the blowoff port 4412, air is blown out which spreads from the center part of the conveyance belt 41 in the width direction toward the +X side end portion.

As described above, wind adjustment is conducted by the wind direction adjustment unit 442 such that air blown out from the blowoff port 4412 of the duct main body 441 toward the conveyance belt 41 spreads from the center part of the conveyance belt 41 in the width direction toward both end portions. This enables the sheet S to be evenly brought into close contact with the conveyance belt 41 in the width direction. Accordingly, the conveyance belt 41 is allowed to have more excellent property of conveying the sheet S.

Further, the wind direction adjustment unit 442 is configured to include a shielding plate 4423. The shielding plate 4423 is arranged so as to couple a +Z side (the upper side) end portion of the first wind direction adjustment plate 4421 located closest to the center part in the width direction (the X direction) among the plurality of first deflector plates 4421 and a +Z side (the upper side) end portion of the second wind direction adjustment plate 4422 located closest to the center part in the width direction among the plurality of second deflector plates 4422 as shown in FIG. 9 and FIG. 10. The shielding plate 4423 functions as a shielding portion which shields air blow from the blowoff port 4412 arranged in the center part of the conveyance belt 41 in the width direction. This enables air blown out from the blowoff port 4412 of the ventilation duct 44A to more reliably spread from the center part of the conveyance belt 41 in the width direction toward both end portions. It is therefore possible to evenly bring the sheet S into close contact with the conveyance belt 41 in the width direction.

Additionally, since the image forming apparatus 1 according to the present embodiment is provided with the sheet conveyance device 40 in which the conveyance belt 41 is allowed to have excellent property of transporting the sheet S, an image formed by the image forming unit 50 is suppressed from having an image failure caused by poor conveyance of the sheet S.

Although the embodiment of the present disclosure has been described in the foregoing, the present disclosure is not limited thereto and allows for variously modified embodiments.

Although in the above embodiment, the description has been made of the configuration in which as the suction unit 43 for bringing the sheet S into close contact with the first surface 411 of the conveyance belt 41, a suction force is generated by sucking air via the suction holes 413 of the conveyance belt 41, the present disclosure is not limited to such a configuration. For example, the suction unit 43 may be configured to include a pair of electrodes having conductivity which is provided on the conveyance belt 41. In this case, the suction unit 43 is to generate an electrostatic suction force between the sheet S and the conveyance belt 41, thereby bringing the sheet S into electrostatic close contact with the first surface 411 of the conveyance belt 41. In such configuration in which the sheet S is brought to have electrostatic close contact, it is not necessary to provide the conveyance belt 41 with the suction holes 413.

Additionally, although in the above embodiment, the description has been made of an ink jet recording apparatus as the image forming apparatus 1, the image forming apparatus 1 of the present disclosure is not limited to an ink jet recording apparatus. The image forming apparatus 1 of the present disclosure only needs to be an apparatus provided with the sheet conveyance device 40 configured to include the conveyance belt 41 and may be an apparatus using each of various kinds of image forming methods (recording methods) such as a laser beam method, a thermal method, a wire dot method, and the like other than an ink jet method.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. A sheet conveyance device which conveys a sheet to a predetermined processing unit, the sheet conveyance device comprising:

a conveyance belt which has a first surface and a second surface on a side opposite to the first surface, and is arranged to be opposed to the processing unit to convey the sheet on the first surface in a predetermined conveyance direction;

a ventilation unit which, on an upstream side of the processing unit in the conveyance direction, blows out air toward the sheet so as to adhere the sheet to the first surface of the conveyance belt; and a suction unit arranged to be opposed to the processing unit with the conveyance belt interposed therebetween to generate a negative pressure between the sheet adhered to the first surface by the ventilation unit and the conveyance belt, thereby bringing the sheet into close contact with the first surface of the conveyance belt, wherein the ventilation unit has a ventilation duct extending in a width direction orthogonal to the conveyance direction of the conveyance belt and including a blowoff port which blows out air toward the sheet, the ventilation duct having an air direction adjustment unit which causes air blown out from the blowoff port to deviate in a direction from a center part in the width direction toward both end portions.

2. The sheet conveyance device according to claim 1, wherein the wind direction adjustment unit includes a plurality of deflector plates arranged in the width direction and zones the blowoff port into a plurality of regions aligned in the width direction, and the plurality of deflector plates includes first deflector plates slanting from the center part in the width direction toward one end portion and being provided to extend toward the blowoff port; and second deflector plates slanting from the center part in the width direction toward the other end portion and being provided to extend toward the blowoff port.

3. The sheet conveyance device according to claim 1, wherein the wind direction adjustment unit includes a shielding portion which shields air blown from the blowoff port arranged in the center portion in the width direction.

4. The sheet conveyance device according to claim 1, wherein the conveyance belt has a plurality of through holes penetrating from the first surface to the second surface, and the suction unit is arranged so as to be opposed to the second surface of the conveyance belt and sucks air through the through holes to generate the negative pressure, thereby bringing the sheet into close contact with the first surface of the conveyance belt.

5. The sheet conveyance device according to claim 1, wherein the suction unit includes a suction device that generates the negative pressure and an exhaust duct which exhausts air sucked by the suction device, and the ventilation duct includes an air introduction port that introduces air into the ventilation duct, with the exhaust duct being connected to the air introduction port so as to allow air exhausted via the exhaust duct to be introduced to the ventilation duct from the air introduction port.

6. An image forming apparatus comprising:

an image forming unit that forms an image on a sheet; and a sheet conveyance device which conveys the sheet to the image forming unit, the sheet conveyance device comprising:

a conveyance belt which has a first surface and a second surface on a side opposite to the first surface, and the conveyance belt being arranged to be opposed to the image forming unit and to convey the sheet on the first surface in a predetermined conveyance direction;

a ventilation unit which, on an upstream side of the image forming unit in the conveyance direction, blows out air toward the sheet so as to adhere the sheet to the first surface of the conveyance belt; and a suction unit opposed to the image forming unit with the conveyance belt interposed therebetween to generate a negative pressure between the sheet adhered to the first surface by the ventilation unit and the conveyance belt, thereby bringing the sheet into close contact with the first surface of the conveyance belt.

7. The image forming apparatus according to claim 6, wherein the image forming unit includes a plurality of line heads which is provided to extend along a width direction orthogonal to the conveyance direction and discharges ink drops onto an upper face of the sheet to form a full-color image, the plurality of line heads being arranged from an upstream side toward a downstream side in the conveyance direction, and the ventilation unit has a ventilation duct which is provided to extend in the width direction and which blows out air toward the sheet, the ventilation duct being jointly provided upstream of the plurality of line heads in the conveyance direction.

* * * * *